US005296898A

United States Patent [19]

Rubin et al.

[11] Patent Number: 5,296,898

[45] Date of Patent: Mar. 22, 1994

[54] METHOD FOR PRODUCING IMAGES

[75] Inventors: Bruce J. Rubin; Peter G. Evans, both of Rochester; Dennis R. Kamp, Spencerport, all of N.Y.

[73] Assignee: Eastman Kodak Company, Rochester, N.Y.

[21] Appl. No.: 925,005

[22] Filed: Aug. 5, 1992

[51] Int. Cl.[5] ..... G03G 15/04; G03G 15/08; G03G 15/09

[52] U.S. Cl. ..... 355/245; 355/251; 355/269

[58] Field of Search ..... 355/245, 251, 253, 269

[56] References Cited

U.S. PATENT DOCUMENTS

| | | | |
|---|---|---|---|
| 3,396,401 | 8/1968 | Nonomura | 346/160 X |
| 3,410,203 | 11/1968 | Fischbeck | 101/1 |
| 3,574,657 | 4/1971 | Burnett | 117/8 |
| 3,723,113 | 3/1973 | Goffe | 96/1.2 |
| 3,798,030 | 3/1974 | Gundlach | 96/1 PS |
| 4,139,853 | 2/1979 | Ghekiere et al. | 346/1 |
| 4,148,057 | 4/1979 | Jesse | 358/4 |
| 4,252,890 | 2/1981 | Haas et al. | 430/292 |
| 4,536,458 | 8/1985 | Ng | 430/41 |
| 4,545,669 | 10/1985 | Hays et al. | 355/251 X |
| 4,626,868 | 12/1986 | Tsai | 346/1.1 |
| 4,637,708 | 1/1987 | Yuasa | 355/245 X |
| 4,711,834 | 12/1987 | Butters et al. | 430/201 |
| 4,883,731 | 11/1989 | Tam et al. | 430/41 |
| 4,942,110 | 7/1990 | Genovese et al. | 430/198 |
| 5,045,879 | 9/1991 | Takaoda et al. | 355/269 X |
| 5,053,821 | 10/1991 | Kunugi et al. | 355/245 |
| 5,075,735 | 12/1991 | Tsuchiya et al. | 355/245 X |

FOREIGN PATENT DOCUMENTS

WO88/04237 6/1988 PCT Int'l Appl. ..... G03F 7/34

OTHER PUBLICATIONS

Printing by Beams of a Laser Beam by D. D. Roshon, Jr. & T. Young, vol. 7, No. 3, Aug. 1964, IBM Tech. Discl. Bull. p. 224.

Display Device Using Laser Beams by D. D. Roshon, Jr. & T. Young, vol. 7, No. 3, Aug. 1964, IBM Tech. Discl. Bull. p. 225.

Xeroprinting Master with Improved Contrast Potential by R. W. Gundlach, vol. 14, No. 4, Jul.-Aug. 1989; Xerox Discl. Journal, pp. 205-206.

*Primary Examiner*—Fred L. Braun

*Attorney, Agent, or Firm*—David A. Howley

[57] ABSTRACT

A uniform layer of charged toner particles is deposited onto a photoconductive layer of an imaging member. The toner particles are imagewise heated to imagewise tack selected ones of the particles to the photoconductive layer. The photoconductive layer is uniformly exposed to actinic radiation to discharge the toner particles while the layer is subjected to a gentle cleaning process which removes the nontacked toner particles.

4 Claims, 2 Drawing Sheets

METHOD FOR PRODUCING IMAGES

CROSS-REFERENCE TO RELATED APPLICATIONS

This application is related to co-pending U.S. Pat. No. 5,138,388, issued Aug. 11, 1992, in the names of Kamp et al. and entitled "HIGH SPEED, LOW POWER PRINTER".

TECHNICAL FIELD OF THE INVENTION

The present invention relates generally to image reproduction apparatus and, more specifically, to a method and apparatus by which toner images are imagewise tacked to an imaging member.

BACKGROUND ART

The above referenced application discloses a method and apparatus for producing images. Such apparatus utilizes a moving imaging member which includes a dielectric layer and a conductive layer maintained at a reference potential such as ground. A substantially uniform layer of charged toner particles is deposited onto the dielectric layer. The uniform layer of toner particles is then imagewise heated with a scanning, intensity-modulated laser beam which softens selected toner particles. This causes the selected toner particles to be lightly tacked to the dielectric layer.

In order to reveal the image, those toner particles which are not lightly tacked to the imaging member (nonselected toner particles) must be removed from the imaging member. This is accomplished by a magnetic brush which utilizes magnetic carrier particles. Typically, a large quantity of nonselected toner particles must be removed from the imaging member in a short period of time in order to efficiently produce images. A problem in removing the charged, nonselected toner particles from the imaging member is that these toner particles are electrostatically attracted toward the conductive layer. Because the dielectric layer is an insulator, the charged, nonselected toner particles cannot be discharged. As a result, it is more difficult and time consuming to remove the charged, nonselected toner particles from the imaging member to reveal the image.

SUMMARY OF THE INVENTION

In view of the foregoing discussion, an object of this invention is to provide a method and apparatus for producing images which allow nonselected toner particles to be easily removed from an imaging member.

In the practice of the invention a substantially uniform layer of charged toner particles is deposited onto an imaging member. This imaging member has a resistivity of less than about $10^{10}$ohm-cm, at least when exposed to actinic radiation and is maintained at a reference potential, such as ground. The layer of charged toner particles is imagewise heated to lightly tack selected toner particles to the imaging member. The nonselected toner particles are removed from the imaging member to reveal the toner image.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
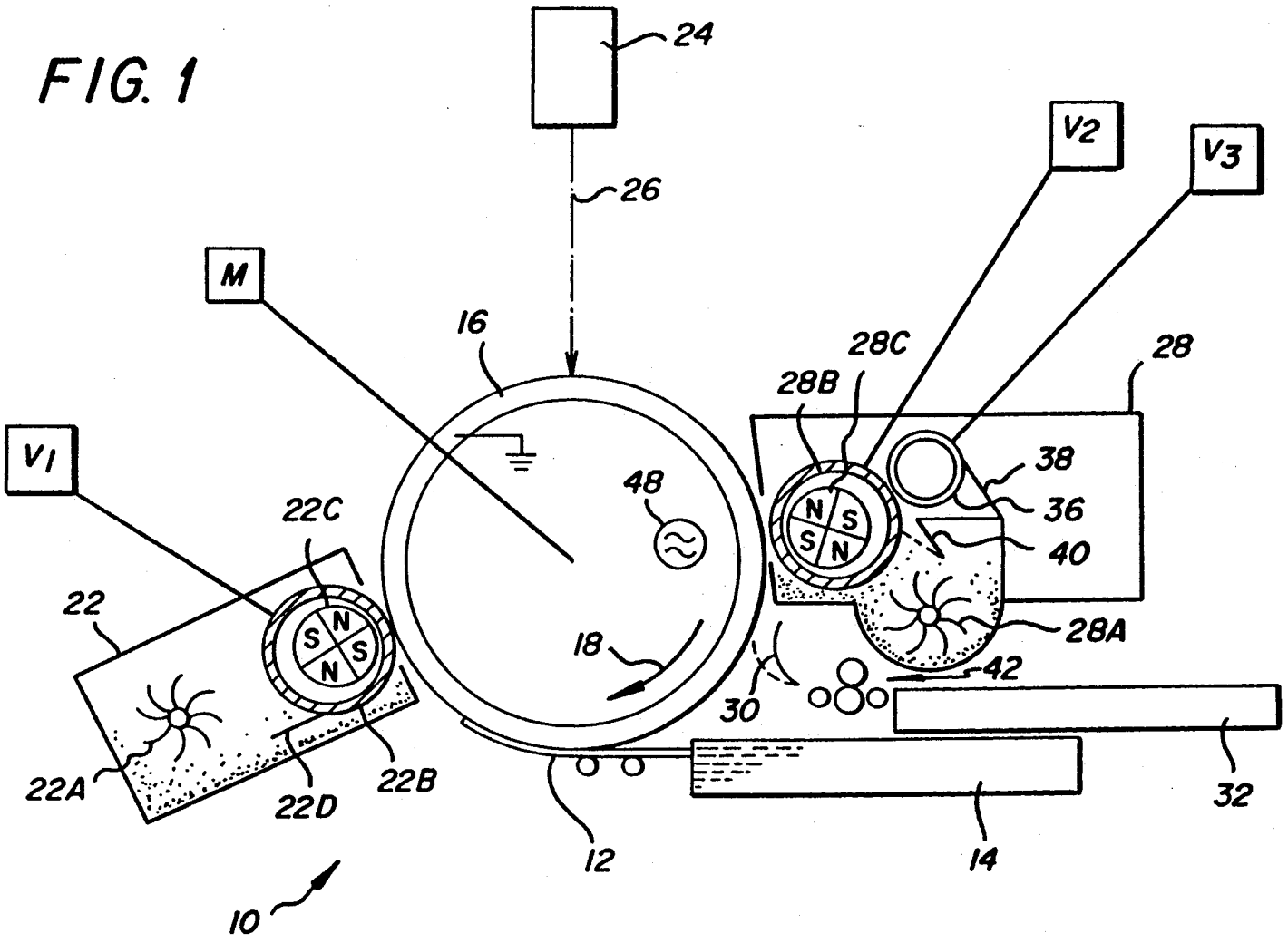
FIG. 1 is a side schematic illustration of an image reproduction system embodying the invention.
Figure 2:
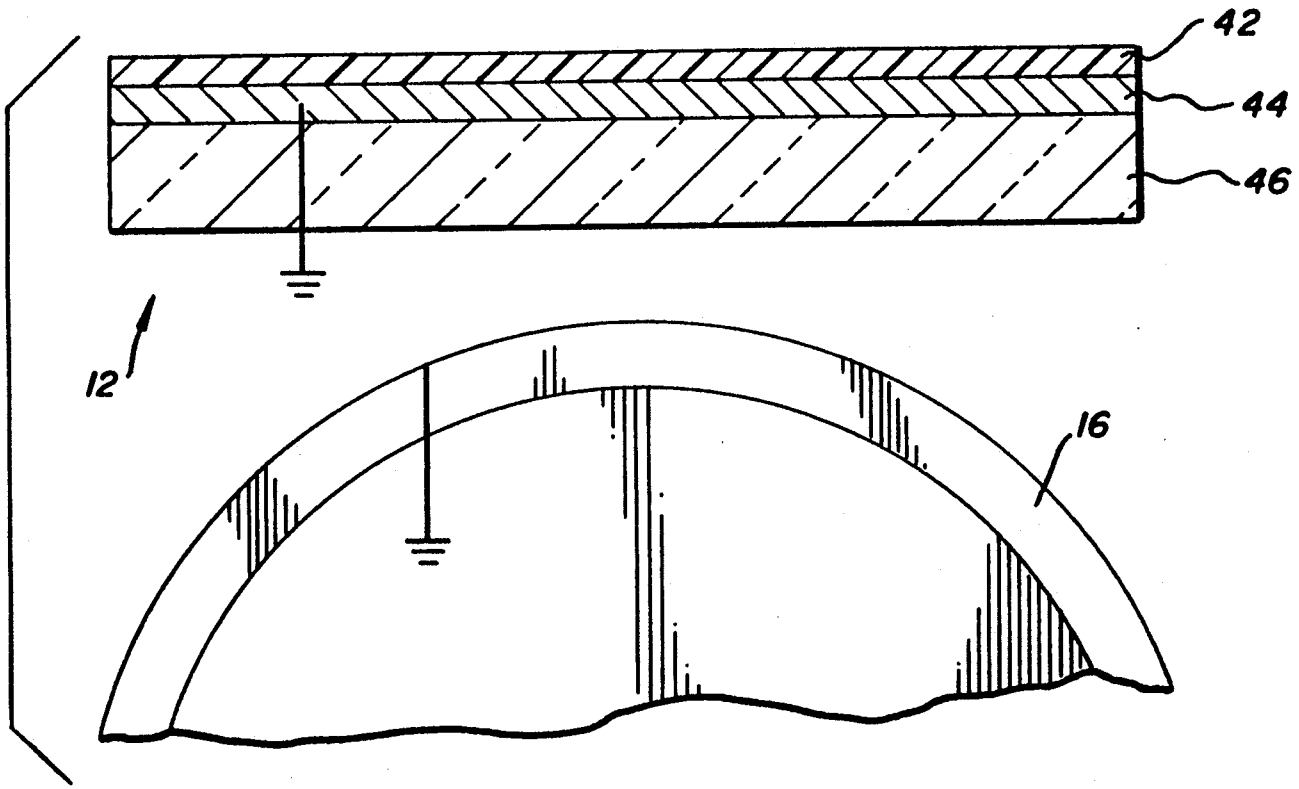
FIG. 2 is a side schematic illustration of an imaging member utilized in the practice of invention.

Turning now to FIG. 1, an image reproduction apparatus, designated generally by the reference numeral 10, is shown. An imaging member 12 is fed from an imaging member supply 14 onto a process drum 16. Process drum 16 is made of an essentially transparent material such as glass and has an outside diameter of about 17 centimeters. As shown in FIG. 2, imaging member 12 includes a photoconductive layer 42, a conductive layer 44 and a support layer 46. A number of photoconductors, such as selenium or organic photoconduc-tors, can be used in this invention. The conductive and support layers are preferably made of a material which will transmit radiation (e.g. light). An example of a material from which conductive layer 44 can be made is cuprous iodide. Support layer 46 can be made of a material such as Kodak Estar TM film base.

Imaging member 12 is held to the process drum by conventional means, such as with the use of a vacuum applied through vacuum holes(not shown) in the surface of process drum 16. The process drum is rotated by a motor M in the direction of an arrow 18 at a surface speed of about 10 cm/sec. Conductive layer 44 is maintained at a reference electrical potential, such as ground. This can be accomplished by, for example, contacting conductive layer 44 to a grounded, conductive strip located along the edge of drum 16.

An electrically biased magnetic brush 22 contains toner particles and magnetic carrier particles(not shown) which together constitute developer mixture. The preferred toner particles are charge injection toner particles which include about 8–20% carbon in a thermoplastic binder(such as poly iso-butyl-methacrylate). The amount of carbon in the toner particles is selected based on how long nonselected toner particles (defined below) will remain on the imaging member and how conductive the photoconductive layer becomes when exposed to light. Generally, within the above range, the longer the toner particles remain on the photoconductive layer and the more conductive this layer is when exposed to light, the lower the carbon content of the toner particles. The desired carbon content provides a partial discharge of the toner particle where the particle contacts the photoconductive layer without completely discharging the particle. These factors control how much the charged nonselected toner particles will discharge while on the imaging member. It is preferred that the carbon be located at or near the surface of the toner particles. Such a toner particle has a glass transition temperature of about between 50–70 degrees Celsius.

The toner and carrier particles are mixed by a rotating auger 22A which causes them to triboelectrically charge to opposite polarities. The developer mixture is deposited on a shell 22B by the auger and remains there due to the carrier particles' attraction to a magnetic core 22C located within shell 22B. The shell is made of a nonmagnetic, conductive material while the core is composed of a series of alternating pole magnets. The core and/or the shell are rotated during operation of brush 22.

As the lead edge of imaging member 12 reaches the interface between shell 22B and drum 16, an electrical bias of several hundred volts and of the same polarity as the charge on the toner particles is applied to shell 22B by a voltage supply V1. This creates an electric field between the shell and conductive layer 44. Charged toner particles leave the carrier particles under the influence of this electric field and are deposited in a substantially uniform layer on photoconductive layer 42 of imaging member 12. The oppositely charged carrier particles remain on shell 22B due to their magnetic attraction to core 22C and to their electrostatic attraction to shell 22B. As the trail edge of imaging member 12 leaves the interface between the shell and drum 16, the electrical bias to shell 22B is shut off, discontinuing the deposition of charged toner particles. The rotation of auger 22A is discontinued. A skive 22D removes the toner particle depleted developer mixture from shell 22B.

Process drum 16 is now accelerated to a surface speed of, for example, about 400 cm/sec. A laser diode 24 emits a laser beam 26 which is intensity-modulated according to image information to be recorded. At a drum surface speed of 400 cm/s a 10–30 micron diameter laser spot of between about 100–300 mW is preferably used. To imagewise heat the layer of charged toner particles, laser diode 24 is indexed via a lead screw about 0.078"/drum revolution, from one edge of process drum 16 to the other edge. Thus, as the laser diode moves, image information is recorded in helical scan lines perpendicular to the axis of rotation of the drum. One scan line is exposed for each revolution of the drum. Alternatively, a group of laser diodes can scan a set of scan lines with each revolution.

Laser beam 26 is focused on the layer of charged toner particles. The duration of laser exposure for each pixel is only long enough to generate enough heat in the selected toner particles to slightly soften the particles. This causes the selected toner particles to be lightly tacked to the imaging member. If the photoconductive layer includes a thermoplastic binder, the laser exposure can also effect a softening of the photoconductive layer which will further assist in tacking toner particles to the imaging member. The selected toner particles need only be lightly tacked because a magnetic removal brush, described below, gently removes nonselected toner particles from the imaging member without disturbing the lightly tacked selected toner particles. Because the selected toner particles need be only lightly tacked to imaging member 12 rather than completely fused, laser exposure can be accomplished much faster. Images can be created at a higher rate.

After laser exposure is complete, process drum 16 is decelerated to a surface speed of about 10 cm/sec. A light exposure source 48, located within drum 16 is activated to expose photoconductive layer 42 to actinic radiation. Alternatively, a light exposure source (not shown) located outside of drum 16 could be utilized instead of light exposure source 48, in which case neither drum 16, conductive layer 44 or support layer 46 need be transparent to light. The light exposure source is selected to emit radiation in a wavelength band effective to cause the photoconductor being used to become conductive while so exposed. The light exposure is maintained during the time that nonselected toner particles are being removed from imaging member 12. This allows the charge on the toner particles on imaging member 12 to exchange charge with the imaging member, where the toner particles contact the imaging member, through the photoconductive layer and conductive layer 16. Because the nonselected toner particles have been partially discharged where they contact imaging member 12, their attraction to conductive layer 44 is reduced. It will now be less difficult to remove the nonselected toner particles from image member 12.

Imaging member 12 is rotated by drum 16 towards a magnetic brush 28 which contains a supply of magnetically "hard" carrier particles. Magnetically "hard" carrier particles are those particles which will flip-flop when exposed to alternating polarity magnetic fields. Typically, these particles have a coercivity in excess of 100 oersteds, and preferably have a coercivity well in excess of 100 oersteds. Examples of materials from which such magnetically "hard" carrier particles can be made are barium ferrite and strontium ferrite.

A rotating auger 28A deposits hard magnetic carrier particles on a shell 28B. The carrier particles remain on the shell because of their magnetic attraction to a core 28C. Shell 28B and core 28C operate in a similar manner to shell 22B and core 22C. The relative movement between shell 28B and core 28C exposes the hard carrier particles to alternating polarity magnetic fields, causing the carrier particles to tumble about the surface of the shell.

As the lead edge of imaging member 12 approaches the interface between shell 28B and drum 16, an electrical bias of between about 25 to 1000 volts and of opposite polarity to the charge previously placed on shell 22B is placed on shell 28B by a voltage supply V2. The imaging member is contacted by the magnetically "hard" carrier particles whose tumbling action knocks the nonselected toner particles loose from the imaging member while not disturbing the selected toner particles. The carrier and nonselected toner particles triboelectrically charge due to their interaction causing them to be attracted to each other. The carrier particles thus remove essentially all the nonselected toner particles from imaging member 12 to shell 28B.

Nonselected toner particles on the carrier particles are removed therefrom by a toner removal roller 36. A voltage is placed on the roller by a voltage supply V3. This voltage is selected such that an electric field is established between shell 28B and roller 36 which will cause toner particles on the carrier particles to transfer to roller 36. Toner particles are removed from the roller by a stripping blade 38.

After imaging member 12 passes by magnetic removal brush 28, a pick-off blade 30 is rotated from its solid line position to its phantom line position in order to remove imaging member 12 from drum 16. The imaging member passes through a fusing station 142 which permanently fuses the selected toner particles to imaging member 12. The imaging member is deposited in an output tray 32. Rotation of auger 28A is discontinued and a skive 40 is rotated from its solid line position to its phantom line position to strip the hard magnetic carrier particles from the surface of shell 28B.

In an alternative embodiment of the invention, layer 42 of imaging member 12 is made of a semiconductive material rather than a photoconductive material. A semiconductive material preferably has a resistivity of between about $10^{10}$ohm-cm and $10^{6}$ohm-cm. Examples of a semiconductive material from which layer 42 can be made are vanadium pentoxide dispersed in a latex binder or styrene N butyl methacrylate/sodium 2 sulfoethyl methacrylate. One advantage of this embodiment is that a single layer semiconducting imaging member, such as paper, can be used. In this embodiment, drum 16 need not be transparent because imaging member 12 does not have to be exposed to light to cause the imaging member to become conductive. Preferably, the outer layer of drum 16 is made of a conductive material which is maintained at a reference potential, such as ground. In this embodiment, conductive layer 44 can be eliminated with the semiconductive layer being connected to the outer layer of drum 16. In addition, no light exposure source is required in this embodiment. As soon as the toner particles are deposited on imaging member 12, they will begin to partially discharge. All other portions of the invention remain the same in this embodiment.

In a third embodiment of the invention, photoconductive layer 42 is eliminated and imaging is accomplished on conductive layer 44. Examples of a conductive material, having a resistivity of preferably less than about $10^6$ohm-cm, from which layer 44 can be made in this embodiment are cuprous iodide, styrene-maleic-anhydride doped with ammonium salts (SMAAS) or aluminum. The SMAAS conductive material has thermoplastic properties, making it softenable by laser beam 26. This softening assists in tacking the toner particles to the conductive layer. In this embodiment, support layer 46 can be eliminated if conductive layer 44 is self supporting.

The nonselected toner particles are partially discharged prior to being removed from the imaging member. As a result, it is much easier to remove these toner particles from the imaging member because their attraction to the conductive layer is reduced. This allows images to be produced at a faster rate than with prior art apparatus or methods.

The invention has been described in detail with particular reference to preferred embodiments thereof, but it will be understood that variations and modifications can be effected within the spirit and scope of the invention.

What is claimed is:

1. A method of producing an image on an imaging member, said method comprising the steps of:

depositing a substantially uniform layer of charged toner particles onto a photoconductive layer of an imaging member in the presence of an electrical field urging the toner particles toward the photoconductive layer, said photoconductive layer contacting a conductive layer which is maintained at a reference potential, such as ground;

imagewise heating said layer of charged toner particles to lightly tack selected toner particles to said imaging member; and uniformly exposing said photoconductive layer to actinic radiation to cause charge injection from said charged toner particles into said photoconductive layer while removing only the nonselected toner particles from said imaging member.

2. The method of claim 1 wherein said charged toner particles are charge injection toner particles.

3. The method of claim 1 wherein said conductive layer is essentially transparent to said actinic radiation and wherein said photoconductive layer is exposed to said actinic radiation through said essentially transparent conductive layer.

4. The method of claim 3 wherein said charged toner particles are charge injection toner particles.

* * * * *